United States Patent [19]

Craig

[11] 3,987,847

[45] Oct. 26, 1976

[54] COMPOSITE MULTIPLE ZONE TEST TOOL

[75] Inventor: John A. Craig, Pointe-A-Pierre, Trinidad And Tobago

[73] Assignee: Texaco Trinidad, Inc., Pointe-A-Pierre, Trinidad And Tobago

[22] Filed: July 17, 1975

[21] Appl. No.: 596,704

[52] U.S. Cl. ..... 166/191; 166/120

[51] Int. Cl.[2] ..... E21B 33/122

[58] Field of Search ..... 166/120, 122, 123, 127, 166/147, 181, 182, 191, 187, 224, 214–217

[56] References Cited

UNITED STATES PATENTS

| | | | |
|---|---|---|---|
| 2,189,697 | 2/1940 | Baker | 166/123 |
| 2,227,539 | 1/1941 | Dorton | 166/224 |
| 2,228,243 | 1/1941 | Baker | 166/123 |
| 2,537,066 | 1/1951 | Lewis | 166/147 |
| 2,862,564 | 12/1958 | Bostock | 166/214 |
| 2,869,645 | 1/1959 | Chamberlain et al. | 166/147 |
| 3,282,342 | 11/1966 | Mott | 166/120 |
| 3,424,246 | 1/1969 | Myers | 166/127 |

*Primary Examiner*—James A. Leppink
*Attorney, Agent, or Firm*—T. H. Whaley; C. G. Ries; Henry C. Dearborn

[57] ABSTRACT

An oil well type of tool for testing a plurality of formations in a single trip into the hole. It has a full bore test tool which has a retrievable packer for making conventional tests. In addition there are a plurality of bridge plugs releasably connected in series below the test tool for plugging the hole above each formation after it is tested, without any additional trips into the hole.

9 Claims, 1 Drawing Figure

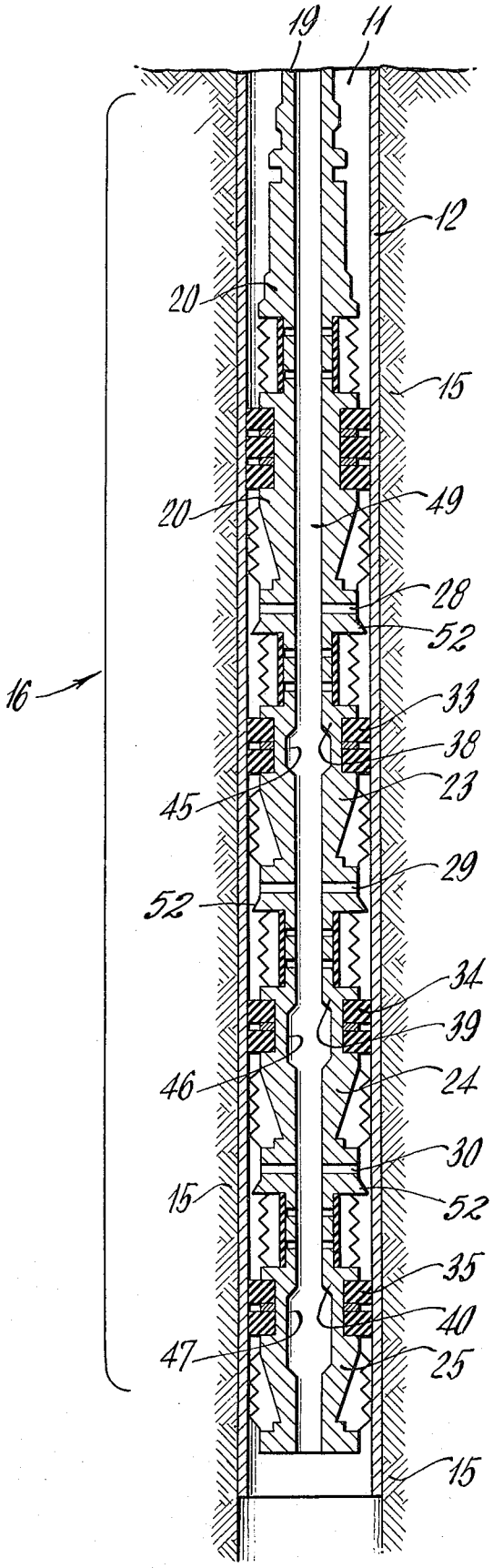
19
11
12
20
15
20
49
28
52
16
33
38
23
45
29
52
34
39
46
24
30
15
52
35
40
47
25
15

COMPOSITE MULTIPLE ZONE TEST TOOL

BACKGROUND OF THE INVENTION

1. Field of the Invention

This invention concerns oil well drilling, in general, and more specifically relates to a tool for use in deep well testing operations.

2. Description of the Prior Art

Heretofore, in making tests of a multiple-zone completed well, it has been necessary to run a test tool down the hole at least once for each formation. Also, the test procedures involved cement squeezing and wireline setting of bridge plugs. Consequently, and particularly in connection with deep hole drilling, the saving in rig time is very substantial if only a single trip into the hole with the test tool could be accomplished.

Consequently, it is an object of this invention to provide a well tool that is able to test and seal off a series of down hole formation zones utilizing hydraulically set bridge plugs and with only a single trip into the hole.

SUMMARY OF THE INVENTION

Briefly, the invention concerns a composite multiple zone test tool for deep well operations. It comprises in combination a full bore test tool adapted for running into a well on a tubing string. It also comprises a plurality of full opening bridge plugs integrally attached to said test tool.

Again briefly, the invention concerns a composite multiple zone test tool for deep well operations, which comprises in combination a full bore test tool adapted for running into a well on a tubing string, and three full opening bridge plugs integrally attached in series below said test tool when in a well. The lowermost of the said bridge plugs is settable with a differential pressure of about 1500 pounds per square inch, and the middle one of said bridge plug is settable with a differential pressure of about 2500 pounds per square inch. Also, the upper most of said bridge plugs is settable with a differential pressure of about 3500 pounds per square inch. The tool also comprises first shear means for detaching the lowermost of said bridge plugs in said series with about a 20,000 pound force, and second shear means for detaching the middle one of said bridge plugs in said series with about a 35,000 pound force. It also comprises third shear means for detaching the uppermost of said bridge plugs in said series with about a 50,000 pound force. Each of the said bridge plugs has a landing groove for receiving a sealing plug selectively therein. The said uppermost bridge plug has the shortest landing groove, and the said middle bridge plug has an intermediate length landing groove. Also, the said lowermost bridge plug has the longest landing groove. Each of the said bridge plugs incorporates a fishing neck for use in retrieving the plugs after testing has been completed.

Once more briefly, the invention concerns the combination of a multiple zone test tool for testing a plurality of vertically spaced formations with a single trip into a borehole. The combination comprises a full bore retrievable portion having a packer for carrying out a formation test, and a plurality of bridge plugs serially attached beneath said retrievable portion when said tool is in the borehole. The said bridge plugs each have means for selectively landing a sealing plug for sealing off said borehole there beneath, following the said formation test. Also, it comprises shear means for the releasing of the said bridge plugs in sequence beginning with the lowermost one.

BRIEF DESCRIPTION OF THE DRAWING

The foregoing and other objects and benefits of the invention will be more fully set forth below in connection with the best mode contemplated by the inventor of carrying out the invention, and in connection with which there is an illustration provided in the drawing, wherein:

The FIGURE of drawing is a schematic crosssectional showing of a tool according to the invention, as located in a borehole.

DESCRIPTION OF THE PREFERRED EMBODIMENT

The drawing FIGURE is a schematic illustration of a tool according to the invention. It is illustrated as being located down hole in a borehole 11, that is shown with a casing 12 in place therein. It will be understood that the borehole 11 penetrates different formations such as a formation 15 that is schematically indicated. After the borehole has been completed, promising formations will be given tests to determine whether or not such formations will produce desired products.

A tool 16 according to this invention is schematically illustrated in cross section and located in the borehole 11. It is attached to the lower end of a string of tubing 19 upon which it is run into the borehole from the surface.

At the upper end of the tool 16, there is a full bore test tool 20. Such a test tool may be like one that is commercially available. It is designated by Halliburton as its Retrievable Test-Treat-Squeeze Packer.

Attached beneath the test tool 20 there are three bridge plugs 23, 24 and 25, in series. These are attached with shear rings 28, 29 and 30 respectively. As will be explained more fully below, the tensile force required to detach each of these bridge plugs is different. The least force is required at the bottom one, so that the bridge plugs may be detached in sequence one at a time.

Each of the three bridge plugs 23–25 is made up of two parts, one part being a packer section 33, 34 and 35 respectively. The other part of each bridge plug is a landing nipple section 38, 39 and 40 respectively. It will be observed that the landing nipple sections 38, 39 and 40 have different length grooves 45, 46 and 47 respectively, which are progressively longer as each bridge plug is added down the tool. By having this structure, a particular sealing plug (not shown) may be dropped down the tubing into the tool when desired, and by beginning with the longest of such sealing plugs (to match the longest landing nipple section 40), that sealing plug will continue down to be seated in that particular landing nipple.

As was the case with the test tool 20, each of the bridge plugs 23–25 may be made up of conventional elements. These elements (bridge plugs) might take the form of a combined hydraulic-set packer and a selective landing nipple. Such tools are both available commercially. For example, Otis Engineering Corporation of Dallas, Texas (a Halliburton Company) supplies a hydraulicset packer designated by the trademark Perma-Trieve. Also, Otis supplies a selective landing nipple that would be appropriate.

It will be observed that there is an open bore 49 which extends the entire length of the tool 16. This permits the desired use of the tool, which will now be described. It may be noted here that the details of the various elements of the entire tool are only indicated schematically since, it will be clear to any one skilled in the art that these elements may be combined as necessary, in order to form a composite multiple zone test tool according to the invention.

OPERATION

The complete tool 16 will be made up with the various parts joined together, as indicated by the description above, showing the tool in a schematic illustration thereof. The upper end of the tool 16 is attached to the tubing string 19 for running everything down into the borehole. The entire tool 16 will be run down hole to a point somewhat above the lowermost formation to be tested. Then the packer of the test tool 20 will be set.

Next, the casing may be perforated at the desired formation. This will be followed by the carrying out of a swab or flow test. Thereafter the packer of the test tool 20 will be released, and a reverse circulation will be carried out to move the formation fluid out through the tubing 19.

The foregoing completes the testing of the first, i.e. the lowest formation down hole. Next, a sealing plug (not shown) that matches the lowermost landing nipple groove 47, will be dropped down the tubing 19 and landed in the groove. It will be noted that it will not be landed in the grooves 45 or 46 in the sections above, since they have shorter grooves.

When the sealing plug has been landed, pressure will be applied in the tubing 19 up to about 1500 pounds per square inch which will set the lower bridge packer section 35. Of course, after the sealing plug has first landed it is good practice to attempt to circulate fluid in both directions first, in order to determine that the plug is properly landed.

After the sealing plug has been landed, as indicated above, by applying the tubing pressure of about 1500 pounds per square inch, the lowermost bridge plug 25 will be set. The lower bridge plug 25 will then be detached by pulling up on the tubing 19 (with tool 16 attached) using a differential force of about 20,000 pounds, which will shear the lower shear ring 30. Then the bridge plug 25 seals off the borehole from that point down, and the tool 16 may be raised to the next formation location that is to be tested.

It will be understood that the same procedure may be carried out again in order to make another formation test, followed by setting the second bridge plug to seal the borehole from that point down. It will be appreciated that for this second test the pressure to set the packer section 34 will be about 2500 pounds per square inch, and the differential force for detaching that bridge plug portion 24 of the tool 16 will be about 35,000 pounds, to shear the next shear ring 29.

The next upper formation may be tested in a similar manner, and pressure for setting the bridge plug will be another step higher as also will be the differential force required to detached the shear ring. Thus, in the indicated structure, the setting pressure for the packer section 33 will be about 3500 pounds per square inch, and the differential force for detaching the shear ring 28 will be about 50,000 pounds pull.

Of course, another formation may be tested with the tool 20 before it is withdrawn from the borehole. Thus, it will be observed that by employing three bridge plug sections 23–25 on the tool 16, tests may be carried out for four different formations without having more than the one trip for the complete tool 16 down into the hole. This will result in substantial saving in rig time as well as avoiding the need for cement squeezing and wireline setting of bridge plugs.

It may be noted that by including a fishing neck 52 on each of the bridge plug sections of the tool, the plugs may be removed after the testing of all formations has been carried out. The removal would be carried out by jaring on the fishing neck in each instance, to release the upper slips and allow the plug to be removed.

While a particular embodiment of the invention has been described above in considerable detail, in accordance with the applicable statutes, this is not to be taken as in any way limiting the invention but merely as being descriptive thereof.

I claim:

1. A composite multiple zone test tool for deep well operations, comprising in combination a full bore test tool adapted for running into a well on a tubing string, a plurality of full opening bridge plugs integrally attached in series below said test tool when in a well, the lowermost of said bridge plugs being settable with a lowest differential pressure, and a plurality of shear means for detaching said bridge plugs in sequence beginning with the lowermost first, said lowermost shear means being sheared with a lowest amount of force.

2. A composite test tool according to claim 1, wherein each of said bridge plugs has means for selectively landing a sealing plug therein.

3. A composite test tool according to claim 2, wherein each of said bridge plugs incorporates a fishing neck for use in retrieving the plugs after testing is complete if desirable.

4. A composite test tool according to claim 3, wherein the number of said bridge plugs is one less than the number of intervals to be tested.

5. A composite test tool according to claim 4, wherein the number of said bridge plugs is three.

6. A composite multiple zone test tool for deep well operations, comprising in combination a full bore test tool adapted for running into a well on a tubing string, three full opening bridge plugs integrally attached in series below said test tool when in a well, the lowermost of said bridge plugs being settable with a differential pressure of about 1500 pounds per square inch, the middle one of said bridge plugs being settable with a differential pressure of about 2500 pounds per square inch, and the uppermost of said bridge plugs being settable with a differential pressure of about 3500 pounds per square inch, first shear means for detaching the lowermost of said bridge plugs in said series with about a 20,000 pound differential force, second shear means for detaching the middle one of said bridge plugs in said bridge plugs in said series with about a 35,000 pound differential force, third shear means for detaching the uppermost of said bridge plugs in said series with about a 50,000 pound differential force, each of said bridge plugs having a landing groove for receiving a sealing plug selectively therein, said uppermost bridge plug having the shortest landing groove, said middle bridge plug having an intermediate length landing groove, and said lowermost bridge plug having the longest landing groove, and each of said bridge plugs incorporating a fishing neck for use in retrieving the plugs after testing is completed.

7. In combination, a multiple zone test tool for testing a plurality of vertically spaced formations with a single trip into a borehole, comprising a full bore retrievable portion having a releasable packer thereon for carrying out a formation test, and a plurality of bridge plugs serially attached beneath said retrievable portion when said tool is in the borehole, said bridge plugs each having means for selectively landing a sealing plug for sealing off said borehole there beneath following said formation test, and shear means for detaching said bridge plugs in sequence beginning with the lowermost one, said shear means comprising a shear type coupling for each bridge plug with different shear strength from the others.

8. The invention according to claim 7, wherein said selective landing means comprises longitudinally different length grooves in said bridge plugs with the longest at the bottom.

9. The invention according to claim 8, also comprising a fishing neck at the top of each bridge plug for use in removing the plug after testing operations are finished.

* * * * *